US006039844A

United States Patent [19]

Malik

[11] Patent Number: 6,039,844

[45] Date of Patent: Mar. 21, 2000

[54] CONTAINMENT SYSTEM FOR COKE DRUMS

[75] Inventor: Tariq Malik, Corpus Christi, Tex.

[73] Assignee: Citgo Petroleum Corporation, Tulsa, Okla.

[21] Appl. No.: 09/169,127

[22] Filed: Oct. 9, 1998

[51] Int. Cl.[7] ..... C10B 39/04; C10B 41/00; C10B 25/10

[52] U.S. Cl. ..... 202/227; 202/229; 202/230; 202/243; 202/253

[58] Field of Search ..... 202/227, 228, 202/229, 230, 243, 293

[56] References Cited

U.S. PATENT DOCUMENTS

| | | | |
|---|---|---|---|
| 1,065,081 | 6/1913 | Reubold . | |
| 3,576,263 | 4/1971 | Abendroth | 214/35 |
| 3,611,787 | 10/1971 | D'Annessa et al. | 73/15.6 |
| 3,780,888 | 12/1973 | Hoffman | 214/18 K |
| 3,917,516 | 11/1975 | Waldmann et al. | 202/227 |
| 3,936,358 | 2/1976 | Little | 201/39 |
| 3,958,700 | 5/1976 | Foy et al. | 214/35 R |
| 4,135,986 | 1/1979 | Cain et al. | 202/227 |
| 4,147,594 | 4/1979 | Cain et al. | 201/39 |
| 4,282,068 | 8/1981 | Flockenhaus et al. | 202/227 |
| 4,284,478 | 8/1981 | Brommel | 202/227 |
| 4,285,772 | 8/1981 | Kress | 201/39 |
| 4,289,585 | 9/1981 | Wagener et al. | 202/227 |
| 4,294,663 | 10/1981 | Tennyson | 201/39 |
| 4,312,711 | 1/1982 | Brown et al. | 202/227 |
| 4,344,822 | 8/1982 | Schwartz et al. | 201/39 |
| 4,358,343 | 11/1982 | Goedde et al. | 201/1 |
| 4,396,461 | 8/1983 | Neubaum et al. | 201/39 |
| 4,409,067 | 10/1983 | Smith | 201/1 |
| 4,437,936 | 3/1984 | Jung | 201/39 |
| 4,469,557 | 9/1984 | Schweer et al. | 201/17 |
| 4,512,850 | 4/1985 | Mosebach | 201/1 |
| 4,557,804 | 12/1985 | Baumgartner et al. | 202/227 |
| 4,588,479 | 5/1986 | Weber et al. | 202/228 |
| 4,614,567 | 9/1986 | Stahlherm et al. | 201/1 |
| 4,634,500 | 1/1987 | Elliott et al. | 201/39 |
| 4,644,750 | 2/1987 | Lockett et al. | 60/641.2 |
| 4,726,465 | 2/1988 | Kwasnik et al. | 202/230 |
| 4,743,342 | 5/1988 | Pollert et al. | 202/227 |
| 4,747,913 | 5/1988 | Gerstenkorn et al. | 202/227 |
| 4,772,360 | 9/1988 | Beckmann et al. | 202/227 |
| 4,802,573 | 2/1989 | Holter et al. | 201/39 |
| 4,832,795 | 5/1989 | Lorenz et al. | 202/228 |
| 4,886,580 | 12/1989 | Kress et al. | 202/228 |
| 4,988,411 | 1/1991 | Schroter | 202/251 |
| 4,997,527 | 3/1991 | Kress et al. | 201/39 |
| 5,024,730 | 6/1991 | Colvert | 196/132 |
| 5,098,524 | 3/1992 | Antalfy et al. | 202/96 |
| 5,628,603 | 5/1997 | Antalffy et al. | 414/216 |
| 5,697,408 | 12/1997 | Reeves | 141/284 |

*Primary Examiner*—Bekir L. Yildirim
*Attorney, Agent, or Firm*—Head, Johnson & Kachigian

[57] ABSTRACT

A system that reduces worker exposure during coke drum unheading and cutting operations and that reduces risk to workers also provides a capacity increase in that the time a coke drum is not being filled is reduced. This system employs a containment shield that safely permits drainage through the bottom head and contains water and coke avalanches.

17 Claims, 4 Drawing Sheets

CONTAINMENT SYSTEM FOR COKE DRUMS

BACKGROUND OF THE INVENTION

Petroleum refining operations in which crude oil is processed to produce gasoline, diesel fuel, lubricants and so forth, frequently produce residual oils that have very little value. The value of residual oils can be substantially increased when processed in a "delayed coker unit". Residual oil, when processed in a delayed coker is heated in a furnace to a temperature sufficient to cause destructive distillation in which a substantial portion of the residual oil is converted, or "cracked" to usable hydrocarbon products and the remainder yields petroleum coke, a material composed mostly of carbon. A large vessel hereafter called a "coke drum" is provided at the furnace outlet to allow sufficient residence time for the hydrocarbons to complete destructive distillation reaction. The typical coke drum is a large, upright, cylindrical, metal vessel that may, for example, be in the order of approximately 90–100 feet in height (27.4–30.4 meters) and 20–30 feet in diameter (6.1–9.1 meters), although the actual structural size and shape of the coke drum can vary considerably from one installation to another.

Typically, a delayed coking unit has an even number of coke drums. The production of coke is a batch process. Coker feedstock is deposited as a hot liquid slurry in a coke drum. Lighter hydrocarbons which are products of destructive distillation flow out the top of the coke drum. Heavier material remains in the coke drum. When a coke drum is filled, residual oil from the furnace is diverted to another coke drum. The liquid mass remaining in the coke drum cools and is quenched as a part of the process. Solid coke formed as the drum cools must be removed from the drum so that the drum can be reused. While coke is being cooled in one or more drums and while the cooled coke is being extracted from one or more drums, other drums are employed to receive the continuous production of coke feedstock as a part of the delayed coker process.

Residual oil is heated to a temperature of typically about 900° F. (477.4° C.). The oil flows directly from the furnace to a coke drum. The liquid mass enters the drum, typically flowing through an opening in the bottom of the drum and, as the liquid level rises, the thermal cracking continues and layers of coke are laid down and solidify as the coke drum is cooled. Eventually the coke drum is filled substantially full with a solid mass.

When a coke drum is filled to the desired capacity, and after feedstock is diverted to another drum, steam is typically introduced into the drum to strip hydrocarbon vapors off of the solid material. The drum remains substantially full of coke that, as it cools, hardens into solid material.

It is a standard procedure to cool coke in a drum by the admission of steam then followed by water, that is, to cool the coke after the hydrocarbon vapors have been stripped off.

After a coke drum has been filled, stripped and then quenched so that the coke is in a solid state and the temperature is reduced to a reasonable level, quench water is drained from the drum through piping to allow for safe unheading of the drum. The bottom opening is uncovered, that is unheaded, to permit removing coke. Shot coke may have plugged off the drain line preventing a complete draining of the drum. Shot coke may also be loosely packed inside the drum and may "cave in" in an avalanche-like fashion and spilling onto the switch deck area below the coke drum causing substantial operating delay and creating potential hazards to personnel. Operating personnel are required to exercise reasonable caution to avoid coke hot water and hot vapors that may be released when a cave-in occurs. Procedures required to minimize the potentially harmful effects of a cave-in usually take a substantial amount of time and are not always completely effective. Once the unheading is complete, the coke in the drum is cut out of the drum by high pressure water jets. If the drum contains shot coke further avalanches my occur.

In some installations, a coke chute is located in a channel below the switch deck floor with a coke pit below it. Once the coke drum head is removed, the chute is raised to mate with the coke drum bottom flange. This process may not be completely satisfactory in that there is exposure to an avalanche of shot coke when raising the chute and the chute may be overwhelmed or may not function in the event of a cave in.

For all the above reasons, decoking a coke drum has been a relatively cautious and slow process especially when shot coke is produced and may expose workmen to a disagreeable and potentially dangerous environment. It is this situation to which the present invention is directed.

This invention provides improved safety when working around coke drums that substantially reduces the exposure of workmen to the hazardous conditions that may be associated with unheading and the initial steps of unloading a coke drum. It also benefits operations because it reduces the time required to safely return the coke drum back to service after removing the coke from the coke drum.

For background information relating to the basic concept of coke drums and the methods, system and processes by which coke is accumulated within a coke drum and removed therefrom, the following United States patents are helpful.

| PATENT NO. | INVENTOR | TITLE |
|---|---|---|
| 1065081 | Reubold | Apparatus For Quenching Coke |
| 3576263 | Abendroth | Extensible Coal Bunker Construction |
| 3611787 | D'Annessa et al | Aparatus For Minimizing Thermal Gradient In Test Specimens |
| 3780888 | Hoffman | Material Transfer Apparatus For A Rotary Drum |
| 3917516 | Waldmann et al | Coke-Cooling Apparatus |
| 3936358 | Little | Method of Controlling The Feed Rate of Quench Water To A Coking Drum ln Response To The Internal Pressure Therein |
| 3958700 | Foy et al | Charging Machines |
| 4135986 | Cain et al | One-Spot Rotary Coke Quenching Car |
| 4147594 | Cain et al | One-Spot Cylindrical Coke Quenching Car and Quenching Method |
| 4282068 | Flockenhaus et al | Apparatus For The Transfer and Quenching of Coke |
| 4284478 | Brommel | Apparatus For Quenching Hot Coke |
| 4285772 | Kress | Method and Apparatus For Handling and Dry Quenching Coke |
| 4289585 | Wagener et al | Method and Apparatus For The Wet Quenching of Coke |
| 4294663 | Tennyson | Method For Operating A Coke Quench Tower Scrubber System |

-continued

| PATENT NO. | INVENTOR | TITLE |
|---|---|---|
| 4312711 | Brown et al | Fluid Cooled Quenching Cars |
| 4344822 | Schwartz et al | One-Spot Car Coke Quenching Method |
| 4358343 | Goedde et al | Method For Quenching Coke |
| 4396461 | Neubaum et al | One-Spot Car Coke Quenching Process |
| 4409067 | Smith | Quenching Method and Apparatus |
| 4437936 | Jung | Process For Utilizing Waste Heat and For Obtaining Water Gas During The Cooiing of Incandescent Coke |
| 4469557 | Schweer et al | Process For Calcining and Carbonizing Petroleum Coke |
| 4512850 | Mosebach | Process For Wet Quenching Of Coal-Coke |
| 4557804 | Baumgartner et al | Coke Cooler |
| 4588479 | Weber et al | Device For Cooling Incandescent Coke |
| 4614567 | Stahlherm et al | Method and Apparatus For Selective After-Quenching Of Coke On A Coke Bench |
| 4634500 | Elliott et al | Method of Quenching Heated Coke To Limit Coke Drum stress |
| 4664750 | Biesheuvel et al | Method For Coke Quenching Control |
| 4726465 | Kwasnik et al | Coke Quenching Car |
| 4743342 | Pollert et al | Coke Quenching Apparatus |
| 4747913 | Gerstenkorn et al | Cooling Apparatus For Granular Coke Material |
| 4772360 | Beckmann et al | Thin Wall Coke Quenching Container |
| 4802573 | Holter et al | Process For Wet Quenching Of Coke |
| 4832795 | Lorenz et al | Coke Dry Cooling Chamber |
| 4886580 | Kress et al | Dry Quenching Coke Box |
| 4988411 | Schroter | Filling Car for a Coke Oven Battery |
| 4997527 | Kress et al | Coke Handling and Dry Quenching Method |
| 5024730 | Colvert | Control System For Delayed Coker |
| 5098524 | Antalfy et al | Coke Drum Unheading Device |
| 5628603 | Antalfy et al | Automated Chute System |
| 5697408 | Reeves | Filling Containers |

For reference to the system for controlling the discharge of coke from the open bottom end of a coke drum, U.S. Pat. No. 5,628,603 entitled "Automatic Chute System" is relevant.

BRIEF SUMMARY OF THE INVENTION

A coke and water containment system has been developed which provides operators of delayed coking units improved margins of safety in draining, unheading and decoking coke drums. This invention utilizes on an exemplified embodiment, concentric cylindrical shields to provide a mechanical shield to protect personnel on the coker switch deck from coke avalanches and hot water.

In one application an outer moveable containment shield is stored up against the bottom of the coke drum and is latched in place when not in use. A stationary upper inner shield is stored inside the moveable assembly. The diameter of the outside containment shield is greater than the diameter of the coke drum.

The outer containment shield has hydraulic actuators and latches to allow it to be lowered so that the bottom of the shield comes to rest on a sealing medium provided on its bottom edge on the switch deck floor. In one installation a canvas fire hose was installed as the sealing medium.

A coke discharge telescoping cylinder is stored in a lower position below the switch deck floor. It is concentric with the coke drum and is designed to provide the maximum diameter available based upon the opening in the switch deck designed for coke to pass through. The other end of the chute is designed to mate with the bottom head of the coke drum when the cylinder is in the raised position.

After quenching a coke drum is complete and the quench water is drained partially, fully or not at all according to the operators choosing, then the outer containment shield is deployed. The coke drum is then unheaded inside the containment system utilizing automatic unheading technology provided by others. One installation includes a remotely controllable boltless fitting on the piping connection to the bottom head and a commercially available unheading device. If the operator desires to partially or fully drain the coke drum or to be certain that drainage is complete, the bottom head is lowered only a few inches until draining is complete. The water is contained safely by the shield and passes through the switch deck to the coke handling system where it is piped away. Then the head is swung completely away and the telescopic cylinder for the discharge of coke is raised and latched in place. Then the hydraulic decoking procedures are begun with the cutting of a pilot hole. If a coke avalanche should occur, it is contained within the containment system.

When the drum is completely decoked the outer shield can be raised and latched again safely in the storage position and the telescopic cylinder is returned to its storage position so any excess coke that got between the cylinders and the shield can be washed through the opening in the switch deck into the pit or pad below.

DESCRIPTION OF THE DRAWINGS

In FIG. 1 the circumferential shield is shown in its lower position.

FIG. 2 shows the bottom flange nearly fully opened.

DETAILED DESCRIPTION OF THE PREFERRED EMBODIMENTS

Figure 1:
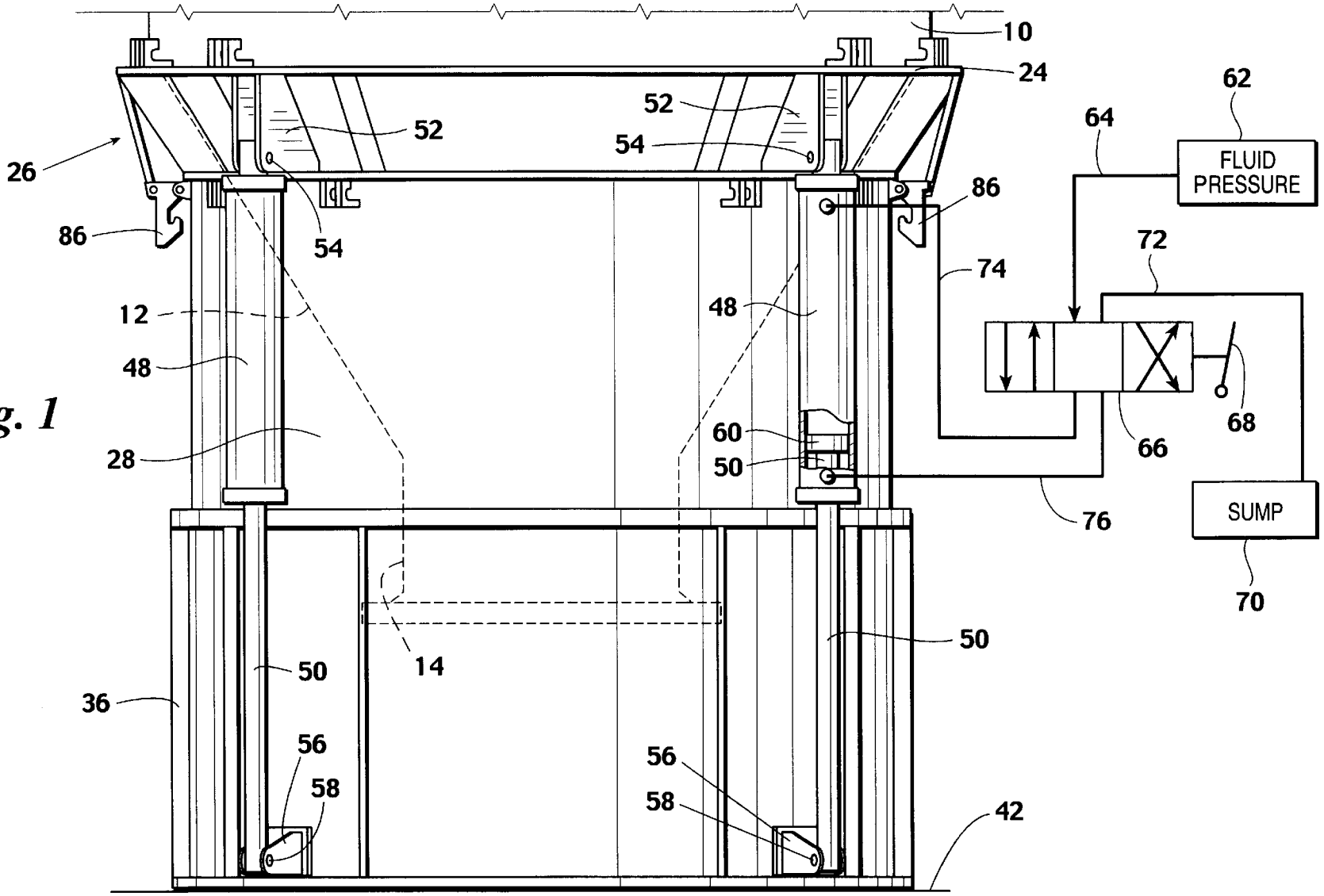
FIG. 1 is an elevational view of the lower portion of a coke drum having a lower end that is supported above a switch deck floor. A circumferential safety shield is supported at the lower end portion of the coke drum and is moveable between a lower position employed during the initial stages of unloading of the coker drum and an upper position after the unloading initial stages are completed.
Figure 2:
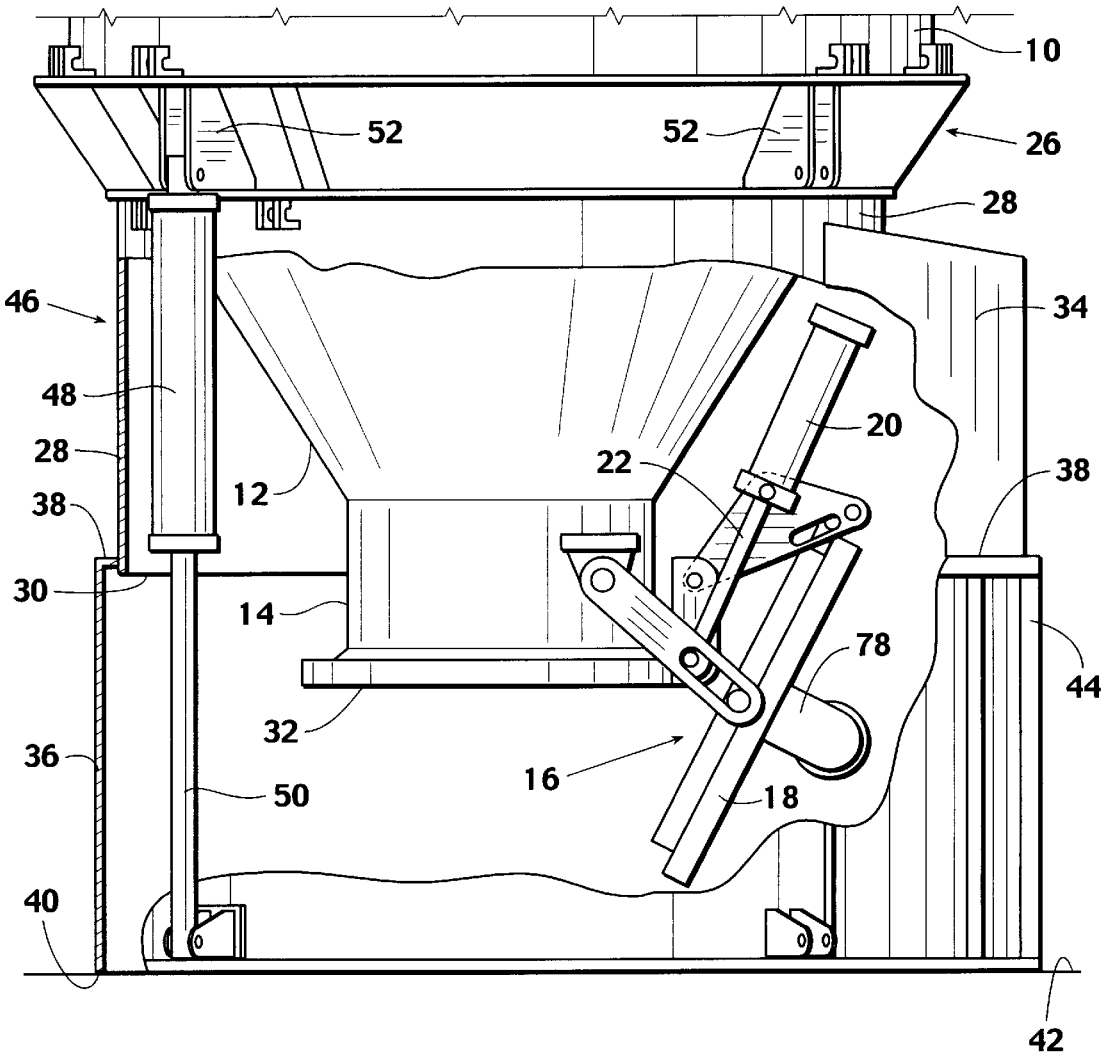
FIG. 2 is an elevational view as in FIG. 1 but showing the shield broken away to reveal mechanisms of the coker drum that are within the shield when the shield is in its downward position and showing one type of bottom flange operating mechanism by which the lower end of the coke drum is closed.

Referring to FIGS. 1 and 2, the cylindrical wall of a coke drum is indicated by the numeral 10. Coke drums are commonly employed in the refining operations for receiving the residue after the most valuable hydrocarbons have been extracted from crude oil. Higher value hydrocarbons attained from crude oil include gasoline, diesel fuel and lubricants. After all these valuable products are removed from crude oil there remains a residual product that, after it has solidified, is commonly referred to as "Petroleum Coke". This product, which is essentially carbon, must be dealt with in a refining operation. It has some commercial value, although the value per volume is much lower than other products derived from crude oil.

The residual material from the refining operation in the form of coker feedstock is supplied to and fills drum 10 to about 80% of its capacity. The liquid product flowing into drum 10 is typically at a minimum temperature of 900° F. Coker drum 10 may be typically about 90–100 feet tall and of a diameter of about 20 to 32 feet, although these dimensions can vary considerably and the exact dimensions are not related to the essence of the invention.

The lower end portion of vessel 10 includes a tapered conical portion 12 that terminates in a lower, smaller diameter cylindrical outlet portion 14 that is closed by a bottom flange structure generally indicated by the numeral 16 as shown in FIG. 2. The bottom flange structure 16 includes a closure plate or lid 18 that can be moved into position to sealably close the bottom open end of cylindrical outlet portion 14 or can be tilted, as shown in FIG. 2, to fully expose the bottom open end of cylindrical outlet portion 14. The bottom flange structure 16 may typically include a hydraulic cylinder 20 having a piston rod 22 extending therefrom that attaches to the mechanism for pivoting closure plate 18 into and out of position to seal against the bottom open end of cylindrical outlet portion 14 or to fully open the cylindrical outlet. The details of the bottom flange structure 16 can vary considerably and are not a part of this invention and are illustrated here only in the way of background information.

Attached to the lower portion of vessel 10 in the transitional area 24 where the full circumferential diameter of the cylindrical sidewall of the coke drum meets conical portion 12 is a mounting structure generally indicated by the numeral 26.

Turning now to FIG. 2, extending downwardly from mounting structure 26 is an inner circumferential shield 28 that is fixed in position. Inner shield 28 has a circumferential lower end 30 that is spaced above the bottom edge 32 of cylindrical outlet portion 14. Inner shield 28 is formed of metal and may be made of metal panels that are welded or bolted together to provide a structure that completely surrounds conical portion 12 of the coke vessel. Inner shield 28 is essentially cylindrical however, when the bottom flange structure 16 is of such construction that a portion thereof may extend outside of a circumferential perimeter, the inner shield 28 is provided with a flange housing portion 34 to accommodate all the working mechanisms of the bottom flange structure.

Telescopically received about inner shield 28 is a circumferential safety shield 36. Safety shield 36 has an upper circumferential edge 38 that is of a height slightly above the lower end 30 of inner shield 28 and has a lower edge 40 that rests on or that is supported at least in close proximity to a switch deck floor 42. The switch deck floor will be described in more detail subsequently.

The circumferential shape of safety shield 36 matches that of the circumferential shape of inner shield 28 which means that the safety shield 36 is substantially cylindrical, to match the cylindrical configuration of the coker vessel 10 but may require provision of an addition 44 to match with the flange housing portion 34 of the inner shield to accommodate bottom flange structure 16.

Figure 3:
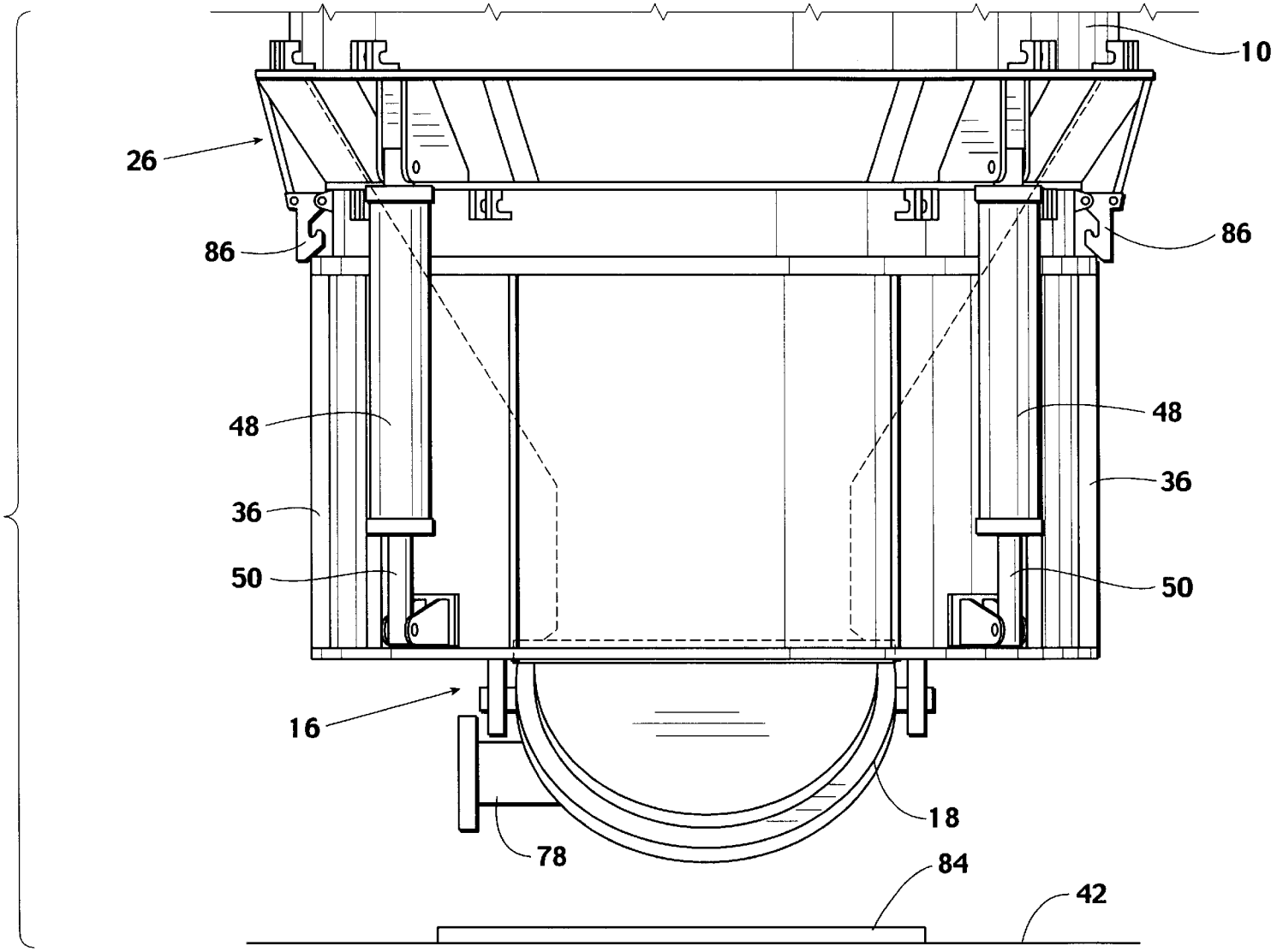
FIG. 3 is an elevational view of the lower end portion of a coke drum as shown in FIG. 2 but the view is rotated 90° and the circumferential shield is shown near its retracted or upper position.
Figure 4:
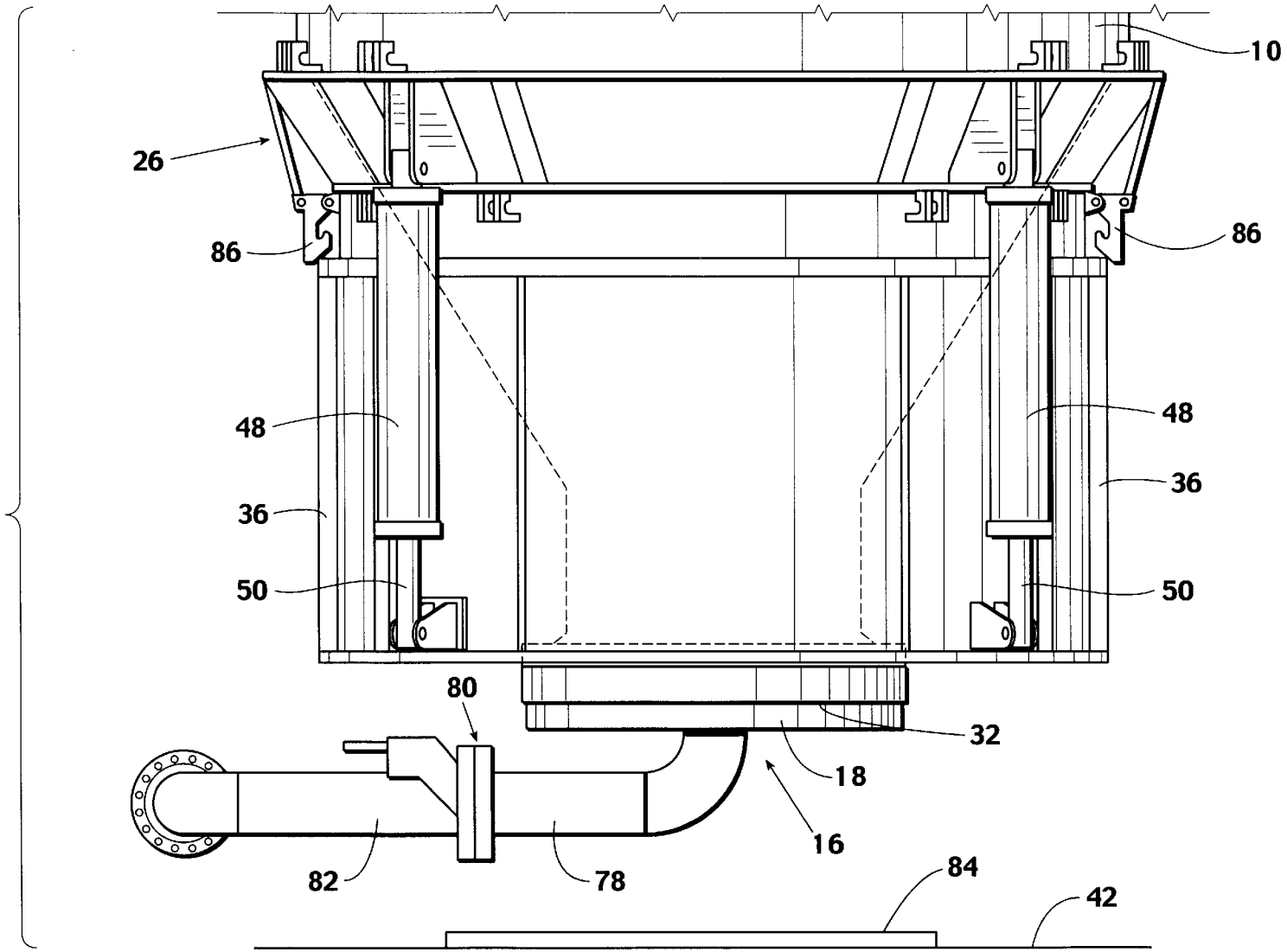
FIG. 4 is a view of bottom portion of a coker drum with the circumferential safety shield in its upper or retracted position and showing the bottom flange in a closed position and showing piping extending from the bottom flange.

Essential to this invention is the provision whereby safety shield 36 may be upwardly positioned, as shown in FIGS. 3 and 4. Safety shield 36 is in a lower position as shown in FIGS. 1 and 2 during the early stages of removing coke that has solidified within drum 10. In the upper position as shown in FIGS. 3 and 4, the entire area below the safety shield is free to access by workmen.

To raise and lower safety shield 36, actuators are employed. The term "actuators" include any mechanical, electrical or hydraulic device to elevationally position safety shield 36. Actuators are indicated generally by the numeral 46 in FIG. 2. In the illustrated embodiment, actuators 46 are in the form of hydraulic cylinders 48. A plurality of actuators are employed, spaced around the entire circumference of mounting structure 26. In the illustrated embodiment, the spacing between hydraulic cylinders 48 is indicative that four of such cylinders are employed circumferentially about the bottom of drum 10. Typically a minimum of at least three actuators are required but any larger number may be used.

In the embodiment illustrated wherein the actuators are hydraulic cylinders 48, each of the cylinders has an extending piston rod 50. A bracket 52 is secured to mounting structure 26 to which the upper end of each of the hydraulic cylinders is secured, such as by means of a pin 54 (See FIG. 1). In like manner, lower brackets 56 are secured to safety shield 36 and the lower end of each of piston rods 50 is secured to a bracket 36, such as by means of a pin 58.

In FIG. 2 the cylinder and piston rod in the right hand portion of the structure are not shown so as to disclose more details of bottom flange structure 16.

A system is required to vertically position safety shield 36. A rudimentary hydraulic flow chart is illustrated in FIG. 1. Right hand hydraulic cylinder 48 is shown broken away to show a piston 60 that is connected to the upper end of piston rod 50. The rudimentary hydraulic flow diagram shows a fluid pressure source 62 (such as a pump) connected by a flow line 64 to a three-position hydraulic valve 66, the position of the valve being controlled, for purposes of illustration, by a lever 68. A fluid sump 70 has a flow line 72 connecting it to valve 66. A third flow line 74 connects valve 66 with the upper interior of cylinder 48, that is, above piston 60, and a fourth flow line 76 connects valve 66 with the interior of cylinder 48 below piston 60. In the simplified diagram valve 66 is shown in an intermediate position so that no fluid flow occurs through the valve. When lever 68 is moved to the right, fluid pressure is caused to flow from conduit 64 through conduit 74 to the top of cylinder 48 moving piston 60 downwardly and when the lever is moved to the left, the direction of flow is reversed so that the source of fluid pressure 62 is connected through valve 66 to flow line 76 to the bottom of piston 60 moving it upwardly. In this simplified illustration, flow lines 74 and 76 would be connected to each of the cylinders. As previously stated, the rudimentary hydraulic flow diagram is included only to illustrate one system by which safety shield 36 is moved from its upper to its lower position and vice versa and the flow diagram is not intended to be illustrative of more sophisticated control systems as are applicable to working installations of the safety improved coke drum. Further, when actuators 46 are electrically or mechanically operated and do not employ hydraulic fluid pressure, then other types of control systems would be applicable.

FIG. 4 is a side view showing containment safety shield 36 in its nearly fully upward position and shows the bottom flange structure 16 in the closed position, that is, wherein closure plate 18 is in sealed contact with the bottom edge 32 of the vessel cylindrical outlet portion. FIG. 4 shows the conditions during which coke drum 10 is receiving coker feedstock, typically injected into the lower end of the vessel and this can be accomplished through conduit 78 that extends from closure plate 18. A disconnecting flange system, generally indicated by the numeral 80, is used when the flow of coke feedstock is terminated. That is, when it is necessary to open the bottom flange structure 16, conduit 78 is separated at the disconnect flange system 80 from the refinery conduit system 82. This allows the conduit portion 78 to be pivoted along with the other portions of bottom flange structure 16 so that the conduit portion 78 is not in the way of the discharge of coke from the vessel when closure plate 18 has been removed.

As shown in FIG. 4, refinery conduit 82 may extend beneath safety shield 36 and, if so, safety shield 36 can be provided with a sliding door (not shown) that receives conduit 82 when the safety shield is lowered to its lower position.

The floor area beneath a coke drum is typically referred to as a "switch deck floor" as previously identified by the numeral 42. Switch deck floor 42 typically has an opening therein that can be closed by a removable deck plate 84. The opening typically has below it a channel (not shown) that connects to a coke pit (not shown) below the switch deck floor. In some instances a retractable cylindrical telescopic chute is connected to the bottom flange of the coke drum before the cutting of a pilot hole and the subsequent cutting of the coke from the drum takes place.

Safety latches 86 are secured to mounting structure 26 and can be arranged to automatically latch onto safety shield 36 when it is raised to its uppermost position. This prevents the shield from inadvertently moving downwardly without first de-actuating the safety latches; a safety feature to protect a workmen below the safety shield in an event that there should be some failure or mis-operation of the hydraulic system or other systems used to raise the safety shield to its upper position. A similar safety latch is provided with the retractable telescopic cylinder for the purpose of discharging coke to the pad, pit or rail cars.

At the end of the quenching cycle when drum 10 is cooled with water for several hours, and depressurized, safety shield 36 is lowered, by actuation of a hydraulic system such as shown in FIG. 1. The safety shield is lowered from its normal retracted position, as shown in FIGS. 3 and 4, to its actuated or lower position as shown in FIGS. 1 and 2. Once the safety shield is lowered in place, the remotely operatible hydraulic bottom flange structure 16 may be unflanged and retracted to drain water from the coke drum. Once the flow of water has subsided or the pressure has declined to a point where it is safe to do so, bottom flange 16 is actuated to swing away closure plate 18 and water is allowed to drain freely from the coke drum. Flange 16 is latched and moved, such as by cylinder 20, to its open position to clear the way for a telescopic chute (not shown) to be pulled up and latched in place inside the safety shield 36. While not shown, inspection windows can be provided in the safety skirt.

The coke drum 10 is now ready for the pilot cut of the solidified coke which is conducted in the normal way and not a part of this invention. Any cave-in or bottom blowout will be contained inside safety shield 36.

The safety shield 36 is kept in its lower or actuated position as shown in FIGS. 1 and 2 during deheading of the drum and the connection of a telescoping chute to the drum bottom outlet. Thereafter the safety skirt can be retracted to its upper position as shown in FIGS. 3 and 4 during the time that coke is cut from the drum. Thus, the safety shield is used essentially during the initial stages of unloading a coker drum and during the time when injury to workmen is most likely to occur. It can also be kept in its lower position during the entire cutting operation.

The invention has been described and illustrated in which a mounting structure 26 is secured to the exterior of a bottom portion of drum 10 for use in attaching the upper end of actuators 46 that in the drawings are represented by cylinders 48. This is by way of example only as cylinders 48 (or other types of actuators) used to vertically position safety shield 36 may be attached to other supporting structure other than the drum itself. For example, drum 10 is shown positioned above switch deck floor 42 but the extensive structure required to support the drum is not shown. Steel columns, usually covered by concrete for fire protection, are typically employed to vertically support each coke drum. Such support structure is not shown in the drawings since it does not relate directly to the essence of the invention. However, rather than being attached to the coke drum itself, or to a ring or railing welded to lugs which are in turn welded to the outside of the drum above the cone section, or to a mounting structure 26 as shown in the drawings, the upper ends of cylinders 48, or other types of actuators, could be secured to a structure not attached to the drum.

The system as illustrated and described herein when properly designed, installed and operated will serve to prevent injury to operating personnel when a bottom drum cave in from shot coke or blow out takes place during the unheading cycle and will prevent injury to operating personnel from hot water and/or steam or coke gushing from the bottom flange.

The safety shield system as described herein permits the use of the bottom head to drain the drum and which will thus reduce the turnaround time for preparing the drum to go back in service and such saving in time can be as much as one to three hours. This time reduction is from the draining cycle and can be used to shorten the coking cycle to increase fresh feed rates by as much as 8% to 30%, subject to other hydraulic constraints. The system as described herein should reduce the number of incidents and/or the time to free up a stuck drill stem and damage to the drill stem from cave ins. This improved safety shield system should provide emotional and psychological benefits to those required to work in the hazardous and somewhat disagreeable conditions surrounding the operation of coke drums.

While the invention has been described herein as being used in producing shot coke it may also be used for any delayed coker such as those making sponge, anode, needle or other speciality cokes.

While the inner shield 34 and the safety shield 36 have been described as being essentially cylindrical, other geometric designs, such as square, hexagonal, etc. may be employed.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

The preferred embody of the invention has been illustrated and described in detail in which a shield is suspended from a coke drum by hydraulic cylinders and is lowered to the switch deck floor prior to unheading the drum. Suspending the shield from the drum is only a preferred but not the only embodiment of the invention. The shield could be suspended from structures other than the drum, such as adjacent columns used to support the drum or specifically provided pillars. The shield could be positioned below the switch deck floor when in a non-actuated or stowed position and then lifted through the opening during deheading of the coke drum. The opening through which the shield is lifted could be wholly or partially annular in shape.

The shield, in various forms, can be used in conjunction with one or more telescoping shields, such as inner shield 28 in the figures or multiple telescoping shields may be employed that move in conjunction with each other.

The invention as illustrated employs a shield that is vertically moved between a stowed and an operating position, and as above indicated, the stowed position could be beneath the floor. In addition, the invention includes the use of a stationary shield of dimensions in a horizontal plane greater than that of a horizontal plane of the coke drum bottom outlet and the unheading apparatus and of vertical height at least about as great as the height of the coke drum bottom outlet above the switch deck floor, the shield at least substantially surrounding an area between the bottom outlet and the switch deck floor and being configured to confine discharges, including steam, water, shot coke and coke avalanches when the drum is unheaded and during the process of drilling solid coke from the drum. The stationary shield could be mounted permanently or semi-permanently on the switch deck floor and may have a closeable opening or openings through which workmen can pass.

The essence of the invention is a containment system around the lower portion of a coke drum to protect workmen from escaping steam, water, shot coke or coke avalanches when the drum lower opening is unheaded and also, optionally, during the process of drilling coke from the drum.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed:

1. An apparatus for confining the discharge of coke, liquids and/or gases from a bottom outlet of a coke drum, the coke drum being supported above a switch deck floor, comprising:

a shield of dimensions in a horizontal plane greater than that of a horizontal plane of the coke drum bottom outlet and of vertical height at least about as great as the height of the bottom outlet above the switch deck floor;

a system to move said shield into position to cover an area from the drum bottom outlet to the switch deck floor.

2. An apparatus according to claim 1 including a coke drum unheading device and an automatic coupling device on coke drum inlet piping bolts contained within said shield and both being remotely operable.

3. An apparatus according to claim 1 wherein said system to move and shield includes actuators in the form of hydraulic cylinders each having a piston rod extending therefrom, the cylinders and piston rods being interconnected between an elevated support and said shield.

4. An apparatus according to claim 1 including:

an inner shield supported adjacent the coke drum bottom outlet and telescopically positioned interiorly of said first mentioned shield.

5. An apparatus according to claim 3 wherein said plurality of actuators are supported to said drum.

6. An apparatus according to claim 1 including a safety interlock system that precounts said shield from accidentally moving to thereby enhance safety operations.

7. A safety improved coke drum supported above a switch deck floor comprising:

an upright coke drum having a sidewall and a lower portion that tapers downwardly and inwardly from a lower end portion of the sidewall to a bottom end that has a large diameter bottom outlet therein, the bottom outlet being spaced above the switch deck floor;

a removable cover closing said bottom outlet;

a shield of dimensions in a horizontal plane greater than that of a horizontal plane of the coke drum bottom outlet and of vertical height at least about as great as the height of the bottom outlet above the switch deck floor; and a plurality of actuators connected to said circumferential shield; and a system to move said shield with respect to said drum bottom outlet to selectably position said shield to encompass an area between said bottom outlet and the switch deck floor.

8. A safety improved coke drum according to claim 7 including a closure for closing said bottom outlet, the closure being supported by supporting structure and wherein said shield is configured to encompass said cover supporting structure.

9. A safety improved coke drum according to claim 7 wherein said system to move said shield includes actuators in the form of hydraulic cylinders each having a piston rod extending therefrom, the cylinders and piston rods being interconnected between a support and said shield being moved vertically to position said shield.

10. A safety improved coke drum according to claim 7 including:

an inner shield supported adjacent the coke drum bottom outlet and telescopically positioned interiorly of said first mentioned shield.

11. A safety improved coke drum according to claim 9 wherein said actuators are supported to said drum.

12. For use with an upright coke drum having a sidewall and a lower portion that tapers downwardly and inwardly from the sidewell to a bottom and that has a large diameter bottom outlet therein, the bottom outlet being spaced above a switch deck floor, a safety system comprising:

a removable cover closing the coke drum bottom outlet;

remotely controllable unheading apparatus for unheading said closure from the bottom outlet; and a shield of dimensions in a horizontal plane greater than that of a horizontal plane of the coke drum bottom outlet and said unheading apparatus and of vertical height at least about as great as the height of the bottom outlet above the switch deck floor, the shield at least substantially surrounding an area between the bottom outlet and the switch deck floor configured to confine discharges from the coke drum when said cover is unheaded from the bottom outlet.

13. A safety system according to claim 12 wherein said shield is moveable between a stowed and an operating position.

14. A safety system according to claim 13 wherein said shield is vertically elevated with respect to the switch deck floor between said stowed and operating positions.

15. A safety system according to claim 14 wherein said shield is vertically elevated about the switch deck floor when moved to the stowed position.

16. A safety system according to claim 14 including at least one fixed shield telescopically position with respect to said vertically elevated shield.

17. A safety system according to claim 14 including safety latches to releasably maintain said shield in said stowed position.

* * * * *